US005359792A

United States Patent [19]

Hanada et al.

[11] Patent Number: 5,359,792

[45] Date of Patent: Nov. 1, 1994

[54] FREE STANDING, UPRIGHT CLOTHES PRESS

[75] Inventors: Toru Hanada, Takarazuka; Atsushi Matsuo, Minoo; Kenichi Iwami, Kobe, all of Japan

[73] Assignee: Matsushita Electric Industrial Co., Ltd., Osaka, Japan

[21] Appl. No.: 939,651

[22] Filed: Sep. 2, 1992

[30] Foreign Application Priority Data

| | | | |
|---|---|---|---|
| Sep. 10, 1991 | [JP] | Japan | 3-229980 |
| Oct. 7, 1991 | [JP] | Japan | 3-258932 |
| Oct. 31, 1991 | [JP] | Japan | 3-285936 |

[51] Int. Cl.[5] ..... D06F 71/28

[52] U.S. Cl. ..... 38/72; 38/66

[58] Field of Search ..... 38/1 R, 1 A, 1 B, 12, 38/15, 16, 19, 26, 36, 43, 66, 70, 71; 24/465, 643; 40/157, 158.1, 159; 100/220, 223; 223/57, 72, 73; 211/195, 198, 199; 220/230; 312/183, 185

[56] References Cited

U.S. PATENT DOCUMENTS

| | | | |
|---|---|---|---|
| Re. 27,368 | 5/1972 | Corby | 38/71 |
| 1,630,894 | 5/1927 | Hamilton | 38/66 |
| 1,885,803 | 11/1932 | Corby | 38/71 |
| 2,499,109 | 2/1950 | Read | 223/61 |
| 3,006,091 | 10/1961 | Roos | 38/66 |
| 3,070,910 | 1/1963 | Dube | 38/71 |
| 3,086,216 | 4/1963 | Brooks et al. | 156/93 X |
| 3,145,490 | 8/1964 | Corby | 38/71 |
| 3,305,956 | 2/1967 | Fleisher | 38/16 |
| 3,468,576 | 9/1969 | Beyer et al. | 220/230 X |
| 3,477,154 | 11/1969 | Corby | 38/71 |
| 3,491,469 | 1/1970 | Niehenke | 38/71 |
| 3,513,573 | 5/1970 | Corby | 38/71 |
| 3,514,021 | 5/1970 | De Dube | 38/71 X |
| 4,232,460 | 11/1980 | Krulwich | 38/1 R |
| 4,498,255 | 2/1985 | Heard | 40/157 X |
| 4,514,918 | 5/1985 | Warner | 24/549 |
| 4,611,419 | 9/1986 | Duplessy et al. | 38/21 |
| 4,682,429 | 7/1987 | Okkerse | 38/36 |
| 4,819,350 | 4/1989 | Engel | 38/30 |

FOREIGN PATENT DOCUMENTS

| | | | |
|---|---|---|---|
| 0654629 | 4/1929 | France | 38/71 |
| 1485042 | 5/1969 | Germany | 38/71 |
| 1037298 | 2/1986 | Japan | 38/15 |
| 2136175 | 5/1990 | Japan . | |
| 0785811 | 11/1957 | United Kingdom | 38/71 |
| 928293 | 6/1963 | United Kingdom . | |
| 1152639 | 5/1969 | United Kingdom . | |
| 1233904 | 6/1971 | United Kingdom . | |
| 2213502 | 8/1989 | United Kingdom . | |
| 2219808 | 12/1989 | United Kingdom . | |

*Primary Examiner*—Clifford D. Crowder
*Assistant Examiner*—Ismael Izaguirre
*Attorney, Agent, or Firm*—Stevens, Davis, Miller & Mosher

[57] ABSTRACT

A vertical-type clothes press, in which clothes such as pants or the like held between a fixed board and a movable board can be pressed for smoothing or creasing, includes a mount base, a fixed board vertically mounted thereon and having a heater, a movable board having a hollow structure for hot-pressing clothes held between itself and the fixed board, a hinge mechanism which rotatably connects the lower ends of the fixed board and the movable board and mounts the movable board openably and closably on the fixed board opposite to each other, a lock mechanism for holding the movable board against the fixed board, a press sheet having one end attached to the connection between the fixed board and the movable board and rotatably provided between the movable board and the fixed board, reinforcements provided along the side end faces of the press sheet in a vertical direction, and a bias device provided on the opposite side of the hinge mechanism for pulling clothes or the like held between the fixed board and the movable board in a direction away from the hinge mechanism. A shift of the centroid becomes small when the movable board is open. Thus, the fixed board can be stably installed in a vertical direction, and a shift in position for the clothes to be pressed is prevented. Further, an operation for putting the clothes in order becomes easy and the clothes are equally smoothed and pressed.

30 Claims, 13 Drawing Sheets

FREE STANDING, UPRIGHT CLOTHES PRESS

BACKGROUND OF THE INVENTION

1. Technical Field

This invention relates to a vertical-type clothes press in which clothes such as a pair of pants or the like held between a fixed board and a movable board can be pressed for smoothing or creasing.

2. Background of the Invention

Conventionally, this type of press, e.g. as disclosed in U.S. Pat. Nos. 2,499,109 and 3,145,490, generally has a fixed board vertically mounted on a mount base and a movable board rotatably coupled to said fixed board through a hinge mechanism provided at the lower end of this fixed board, whereby cloths such as pants or the like are held between the fixed board and movable board and then hot-pressed.

The both fixed and movable boards described above have lengths required for pressing the great part of clothes such as pants or the like, and are formed of thick wooden boards so as to provide a substantial pressing pressure when the clothes are pressed.

When it is required to set the clothes such as pants or the like on said vertical-type clothes press, the movable board is rotatably moved with the clothes toward the fixed board to press them therebetween, after the shape of the clothes is put in order on the movable board in the open state in which the movable board is inclined toward this side.

In one of the vertical-type clothes presses clothes are lifted up during the process which the movable board is moved with the clothes close to the fixed board, e.g. as disclosed in U.S. Pat. Nos. 1,885,803, 3,070,910, and 3,477,154.

However, there are the following problems in conventional vertical-type clothes press having such structure.

First of all, it is required to rotatably move the movable board in the direction away from the fixed board when clothes are set on the press. Especially, when the heavy movable board formed of a thick wooden board is in its open state, the centroid of the press shifts to the side of rotational movement of the movable board, so that, the fixed board vertically mounted on the base is unstable and easy to fall.

Namely, since the centroid of the entire press shifts in the open direction when the movable board is open, it is required to increase the whole mass of the mount base to accommodate for the shift of its centroid, in order to maintain the press steady. Consequently, the mount base becomes large-sized to occupy a wide space for installation, and in addition to this, such a big base may stumble or trip an operator's foot to hurt, and be an obstacle when an operator stands in front of the press to work.

Since a job for putting the clothes in order is performed on the movable board in the open state in which it is inclined on this side, an additional force exerts in the open direction on the said movable board in the open state to inevitably make said base large in size so as to mount the fixed board steady.

Secondly, in the case of finishing closes with this vertical-type clothes press, it is required to change the position of the clothes with the movable board up to the vertical state, since the movable board is moved toward the fixed board to press the clothes after the clothes are put in order on the side of the movable board inclined.

Consequently, the clothes may move downward, or the shape put in order may also be in disorder.

For example, as shown in FIG. 21, a horizontal-type clothes press adapted to be placed on a flat floor in use has also been desired such that the clothes B put in order on the fixed board A placed in a horizontal state are held by a transparent thin sheet C, so as to prevent the clothes B from moving disorderly.

In this horizontal-type clothes press, the following procedures can be easily performed: the clothes B is set on the fixed board A mounted in a horizontal state; and the clothes B set is pre-held by sheet C. However, the thin sheet used for this horizontal-type clothes press easily bends and is not able to stand alone in the inclined or vertical state, so that in a vertical-type clothes press used in the inclined or vertical state, such a thin sheet can not pre-hold the clothes on the movable board to prevent the clothes from moving disorderly.

Thirdly, it is well known that a pair of exemplary pants D finished with this vertical-type clothes press, as shown in FIG. 22, become baggy at the front parts F of the cylindrical parts E corresponding to knees and creased at the rear parts G and the front parts H of the third joints by being worn.

In order to eliminate creases and bags produced at respective parts of such pants D, it has been also performed that the pants D are lifted up during the process in which the movable board comes close to the side of the fixed board. However, in the configuration as described above, the upper parts of the pants D are lifted up as the movable board comes close to the side of the fixed board, but the front parts F and rear parts G of knees are not substantially extended, so that a preferred smoothing effect can not be obtained.

SUMMARY OF THE INVENTION

The first object of the present invention is to provide a vertical-type clothes press which can be vertically stood steady by making a shift of the centroid small when a movable board is open. The second object of the present invention is to provide a vertical-type clothes press which can prevent clothes being pressed from moving disorderly, and can facilitate a job in putting clothes in order. The third object of the present invention is to provide a vertical-type clothes press which can smooth clothes equally and press them.

In order to achieve said first object, the present invention comprises a fixed board and a movable board, at least one of which has a heater, and for hot-pressing clothes or the like, a mount base which fixes the lower end of said fixed board to make the board stand vertically, a hinge mechanism which rotatably connects the lower ends of said fixed board and movable board to each other, and supports said movable board in opposed relationship to said fixed board so as to freely open, and a lock mechanism for holding said movable board to bias the same against said fixed board, said movable board being of a hollow structure.

In order to achieve said second object, the present invention comprises a fixed board and a movable board, at least one of which has a heater, and for hot-pressing clothes or the like, a mount base which fixes the lower end of said fixed board to make the board stand vertically, a hinge mechanism which rotatably connects the lower ends of said fixed board and movable board to each other, and supports said movable board in opposed relationship to said fixed board so as to freely open, a lock mechanism for holding said movable board to bias the same against said fixed board, a press sheet having its one end attached to the convention between said fixed board and said movable board, and rotatably provided between said movable board and said fixed board, and reinforcements provided in the vertical direction along the side end faces of said press sheet.

In order to achieve said third object, the present invention comprises a fixed board and a movable board, at least one of which has a heater, and for hot-pressing clothes or the like, a hinge mechanism which rotatably couples one end of said fixed board to one end of said movable board to make said movable board openable and closable with respect to said fixed board, biasing means provided at the opposite sides of said hinge mechanism for pulling clothes held between said fixed board and said movable board in a direction away from said hinge mechanism, said biasing means comprising a press device provided at either of said fixed board and said movable board and rotatably held and urged onto the inner side by means of a spring, and slide plates provided opposite to said press device, and for holding clothes between itself and said press device, and said slide plates being adapted to slide in the direction of pulling clothes in cooperation with the rotatable movement of said press device.

The vertical-type clothes press according to the present invention is constructed such that a movable board is reduced in weight so as to make the shift of centroid small when said movable board is open. Consequently, the size of a mount base can be reduced for a steady vertical installation. Thus, the extension of the base on this side becomes so small that it can no longer get in the way in use, and it can be safely installed at a small space without a person stumbling over the base.

Further, the mass of the movable board gets small, so that an impact caused by opening/closing can be also reduced to improve the durability of coupling members and facilitate setting the strength.

The vertical-type clothes press according to the present invention is constructed such that a press sheet can stand steady without bending even in the inclined and vertical positions. Consequently, clothes held in order can be firmly fixed on an inclined movable board, and the downward shift of clothes caused by the rotatable movement of a movable board can be also prevented.

Further, the provision of a holder for holding the press sheet on the fixed board makes it possible to hold the press sheet on the side of the fixed board while clothes are put in order on the movable board. Accordingly, the procedures in setting clothes can be easily performed since the press sheet does not fall down to the side of the fixed board while clothes are put in order.

Further, the vertical-type clothes press according to the present invention is constructed such that clothes can be lifted up while being held between a rotating press device and slide plates upwardly sliding. Accordingly, even if clothes include 2 pieces of pants, a tension force can be stably applied to the both pants, and the front parts and the rear parts of the pants corresponding to knees can be fully smoothed.

DESCRIPTION OF THE PREFERRED EMBODIMENTS

An embodiment according to the present invention will be described hereinunder with reference to the accompanying drawings.

Figure 4:
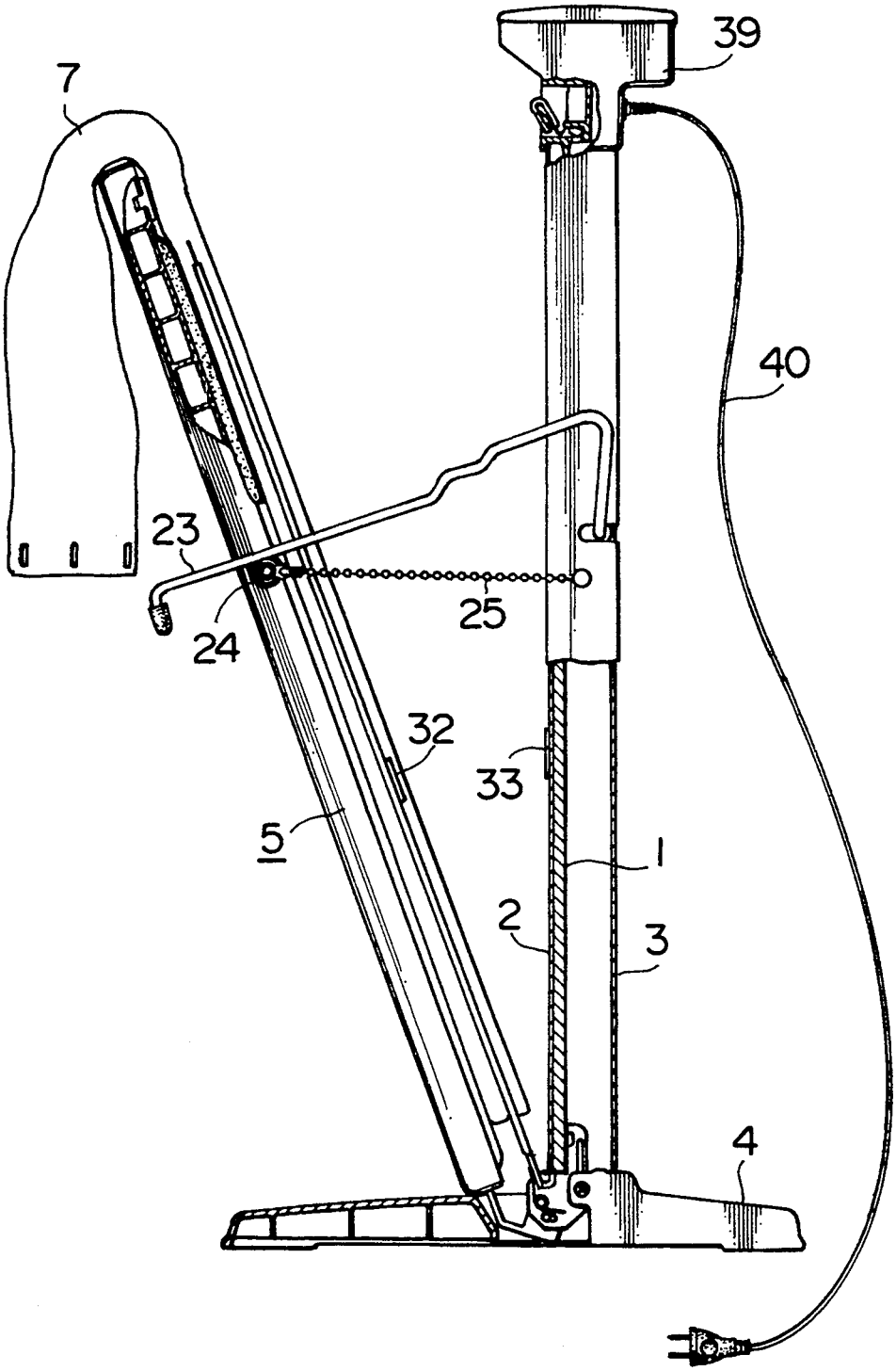
FIG. 4 is a fragmentary sectional view illustrating the vertical-type clothes press shown in FIG. 1 with a movable board being open.

As shown in FIG. 4, a fixed board 1 composed of a plywood has a heater (not shown) covered by a heater cover 2 on its inner side and has its back side covered by a back cover 3. The fixed board 1 is vertically mounted on a mount base 4.

Figure 5:
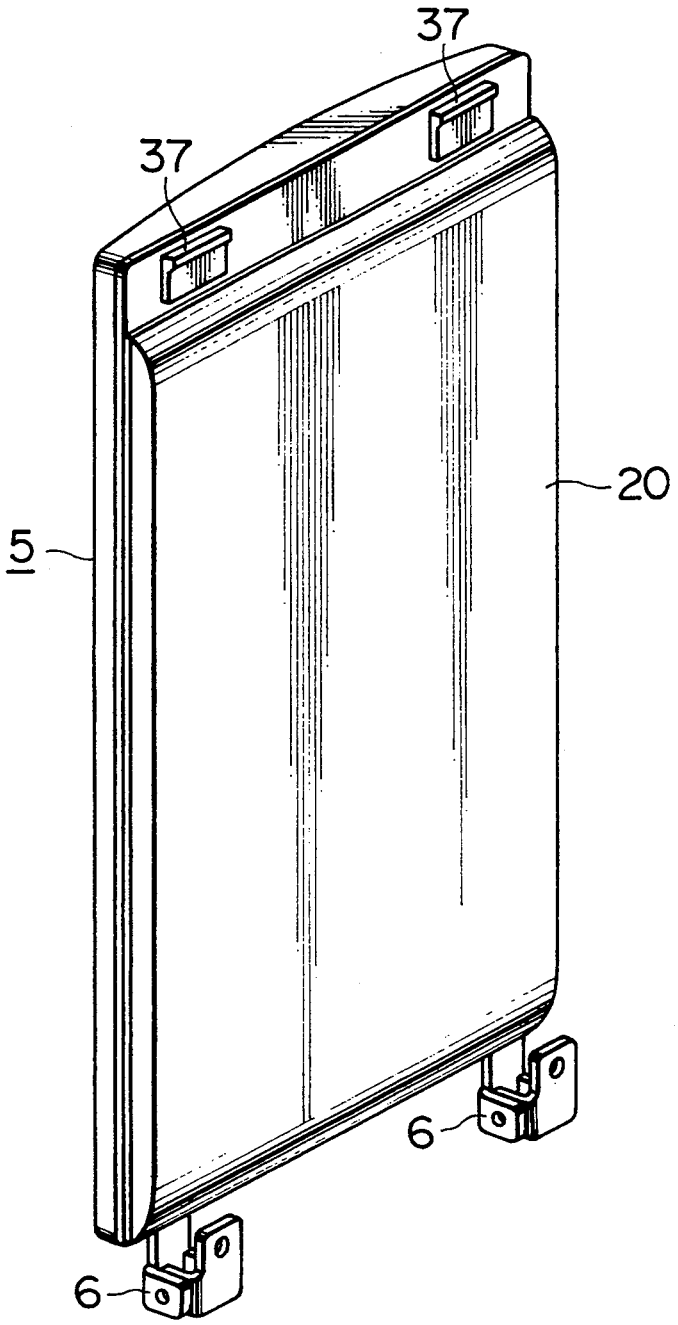
FIG. 5 is a perspective view illustrating the movable board of the vertical-type clothes press shown in FIG. 1.

A movable board 5 is rotatably coupled at its lower end to the lower end of said fixed board 1 by means of a pair of hinge mechanism 6 shown in FIG. 5, and has the same shape as said fixed board 1 to be opposite thereto. The movable board 1 is sufficiently large to hot-press clothes 7 held between it and said fixed board 1.

Figure 6:
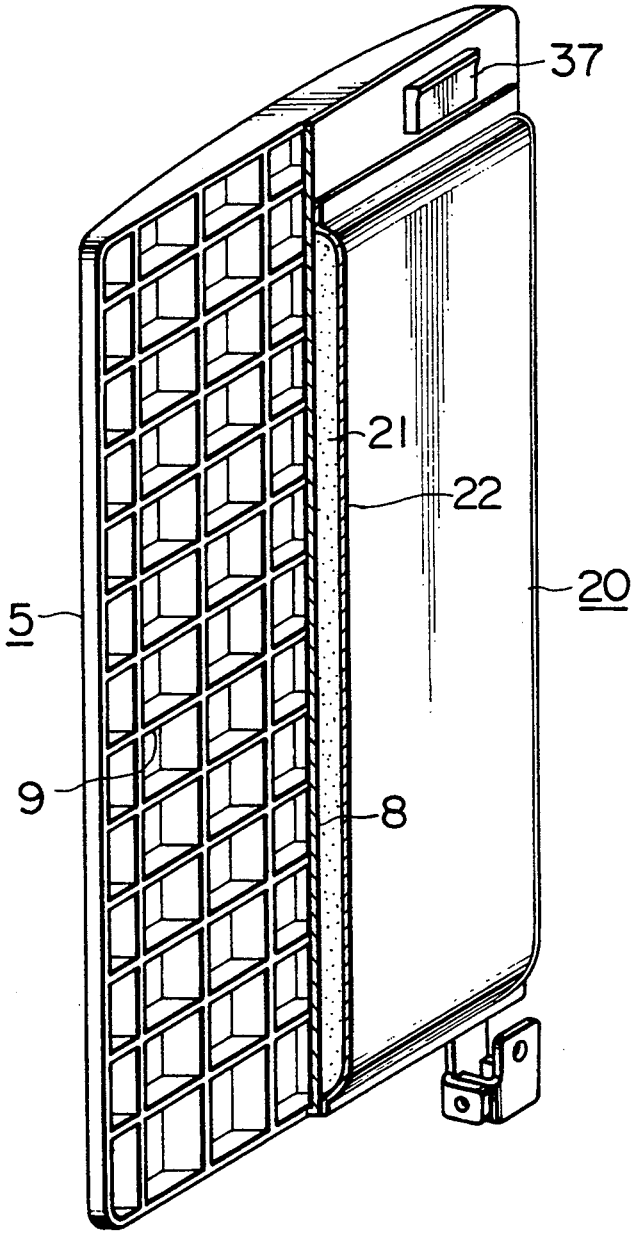
FIG. 6 is a partially cutaway perspective view illustrating the movable board of the vertical-type clothes press shown in FIG. 1.

As shown in FIG. 6, said movable board 5 is constituted by a hollow structure which comprises a flat panel 8 for pressing clothes 7, center cores 9 for supporting the panel 8, and an outer wall 10 provided opposite to said panel 8. This structure is formed of a material such as plastics, paper, and light metals, for example, aluminum, or a combination thereof.

Figure 7:
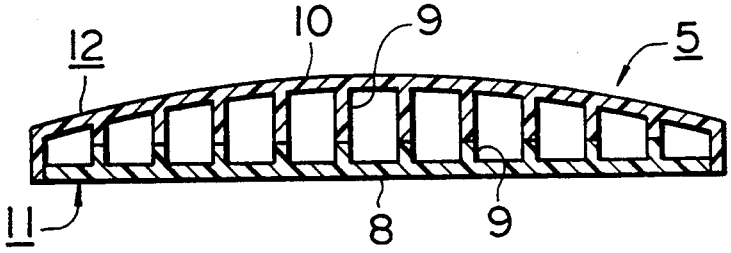
FIG. 7 is a partly sectional view illustrating the movable board of the vertical-type clothes press shown in FIG. 1.

Specifically, as shown in FIG. 7, an inner side member 11 comprising a panel 8 and center cores 9 integrally formed of polypropylene resin, and an outer side member 12 comprising center cores 9 and an outer wall 10 integrally formed of polypropylene resin, are joined as by means of heat seal or the like to form a hollow structure.

Figure 8:
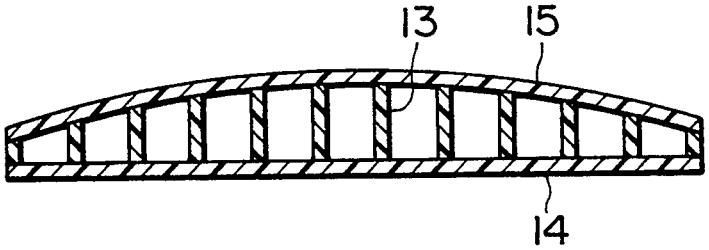
FIG. 8 is a partly sectional view illustrating another embodiment of the movable board of the vertical-type clothes press shown in FIG. 1.
Figure 9:
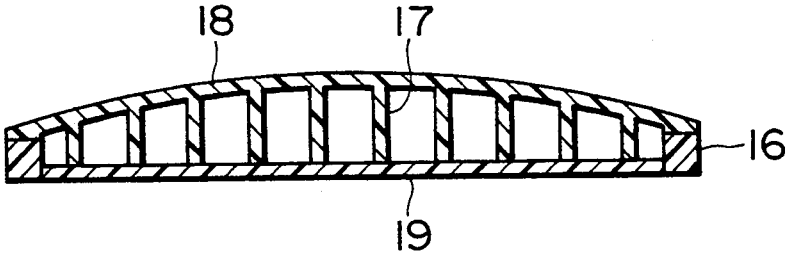
FIG. 9 is a partly sectional view illustrating another embodiment of the movable board of the vertical-type clothes press shown in FIG. 1.

Said movable board 5, as shown in FIG. 8, can be formed by joining an inner panel 14 and an outer panel 15 to the both sides of inner cores 13. Alternatively, as shown in FIG. 9, a frame member 16 is provided to constitute a periphery part of the movable part 5, and an inner panel 19 formed integral with center cores 17 is joined to the frame member 16 by means of adhesion or the like to constitute a hollow structure.

Figure 10:
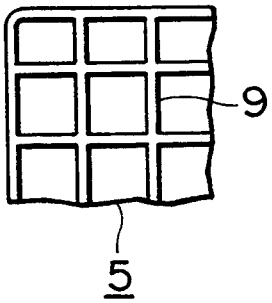
FIG. 10 is a partly enlarged plan view illustrating center cores in the movable board of the vertical-type clothes press shown in FIG. 1.
Figure 11:
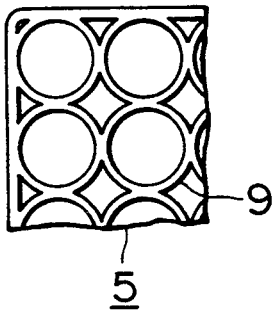
FIG. 11 is a plan view illustrating another embodiment of the center cores of the vertical-type clothes press shown in FIG. 1.
Figure 12:
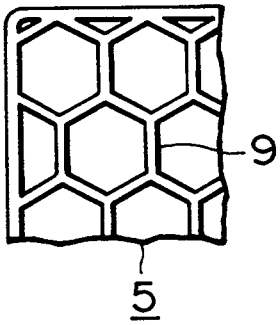
FIG. 12 is a plan view illustrating another embodiment of the center cores of the vertical-type clothes press shown in FIG. 1.

The inner cores 9, as shown in FIG. 10–12, are shaped successively in grids, cylinders and polygonal cylinders so that the movable board 5 can be made so as to reduce its weight and provide its substantial mechanical strength.

Figure 13:
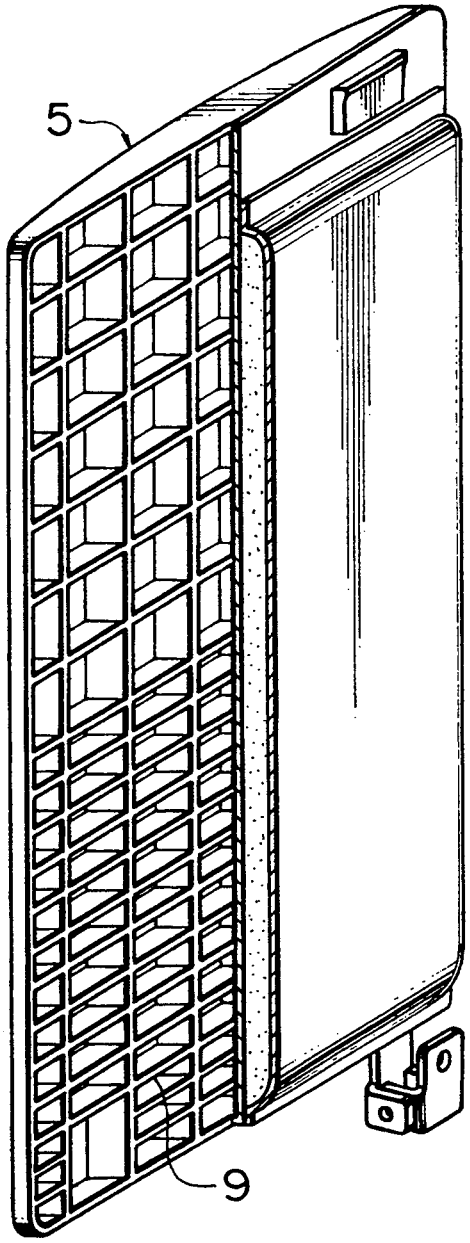
FIG. 13 is a partly cutaway perspective view illustrating another embodiment of the movable board of the vertical-type clothes press shown in FIG. 1.
Figure 14:
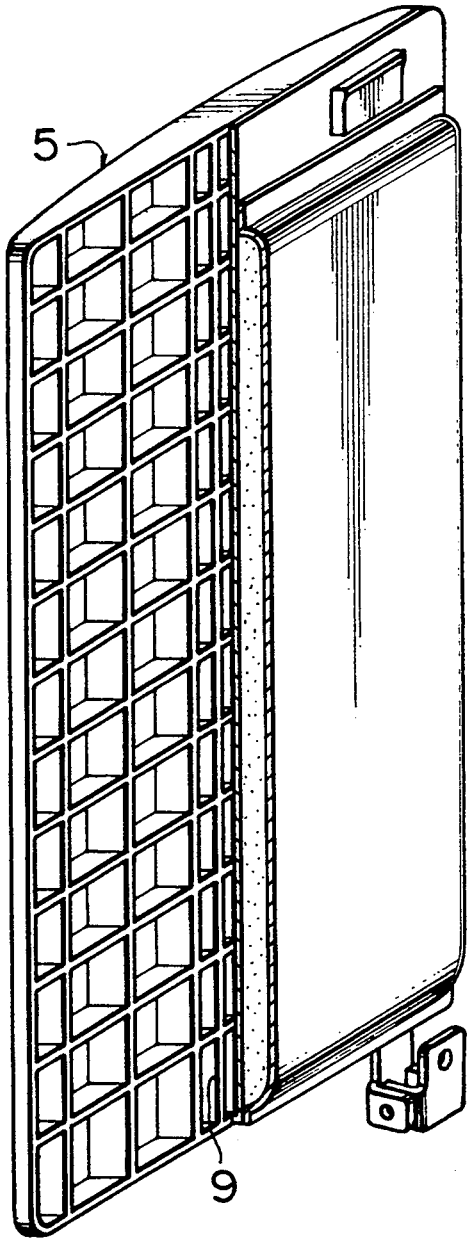
FIG. 14 is a partly cataway perspective view illustrating another embodiment of the movable board of the vertical-type clothes press shown in FIG. 1.

As shown in FIG. 13, the inner cores 9 are constructed such that they are smaller in height as they come toward the lower portion of the movable board 5, and accordingly the movable board 5 has a great rigidity to have less distortion when clothes 7 are held. Further, as shown in FIG. 14, the inner cores 9 are constructed such that they are smaller in width as they come toward the center of the movable board 5 in a widthwise direction, and accordingly the movable board 5 can be formed in much more rigid hollow structure in the same manner as in FIG. 13.

Further, said movable board 5 may be in the form of a hollow structure having a foamed material in the panel.

As shown in FIG. 6, the reference numeral 20 designates a press member formed on the inner side of said movable board 5. The press member 20 comprises a cushion 21 formed of, for example, a soft foamed polyurethane and having a sheet of a high surface hardness on its surface, and a cover 22 covering the surface of the cushion 21. The inner side of the movable board is almost completely covered by the press member.

As shown in FIG. 4, the reference numeral 23 designates a lock mechanism, of which one end is rotatably pivoted on the back side of said fixed board 1, and, of which the other end is provided on the upper part of a lock receiver 24 provided at said movable board 5, and the mechanism 23 holds clothes 7 between said fixed board 1 and said movable board 5 in the pressed state. The reference numeral 25 designates a stopper made of chain or the like for regulating the opening at a determined position, and couples said fixed board 1 to the movable board 5.

Figure 3:
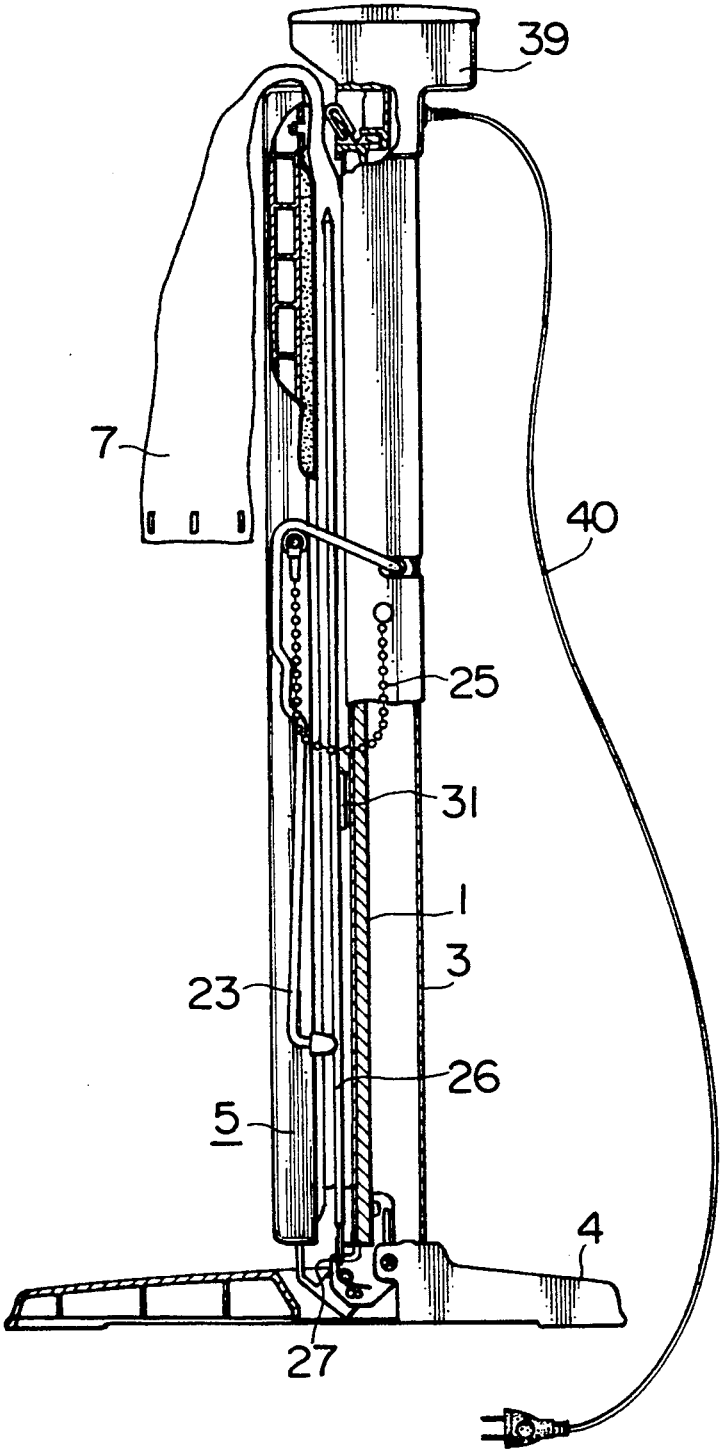
FIG. 3 is a fragmentary sectional view illustrating the vertical-type clothes press shown in FIG. 1.

As shown in FIG. 3, the reference numeral 26 designates a press sheet which has one end attached onto the side of the connection between said fixed board 1 and said movable board 5, and is rotatably arranged on a shaft 27 provided between said fixed board 1 and said movable board 5. The press sheet 26 is formed of a transparent or semitransparent thin film such as polyethylene terephthalate resin, for example, so as to enable viewing the state of clothes 7 held on said movable board 5 through the press sheet 26.

Figure 1:
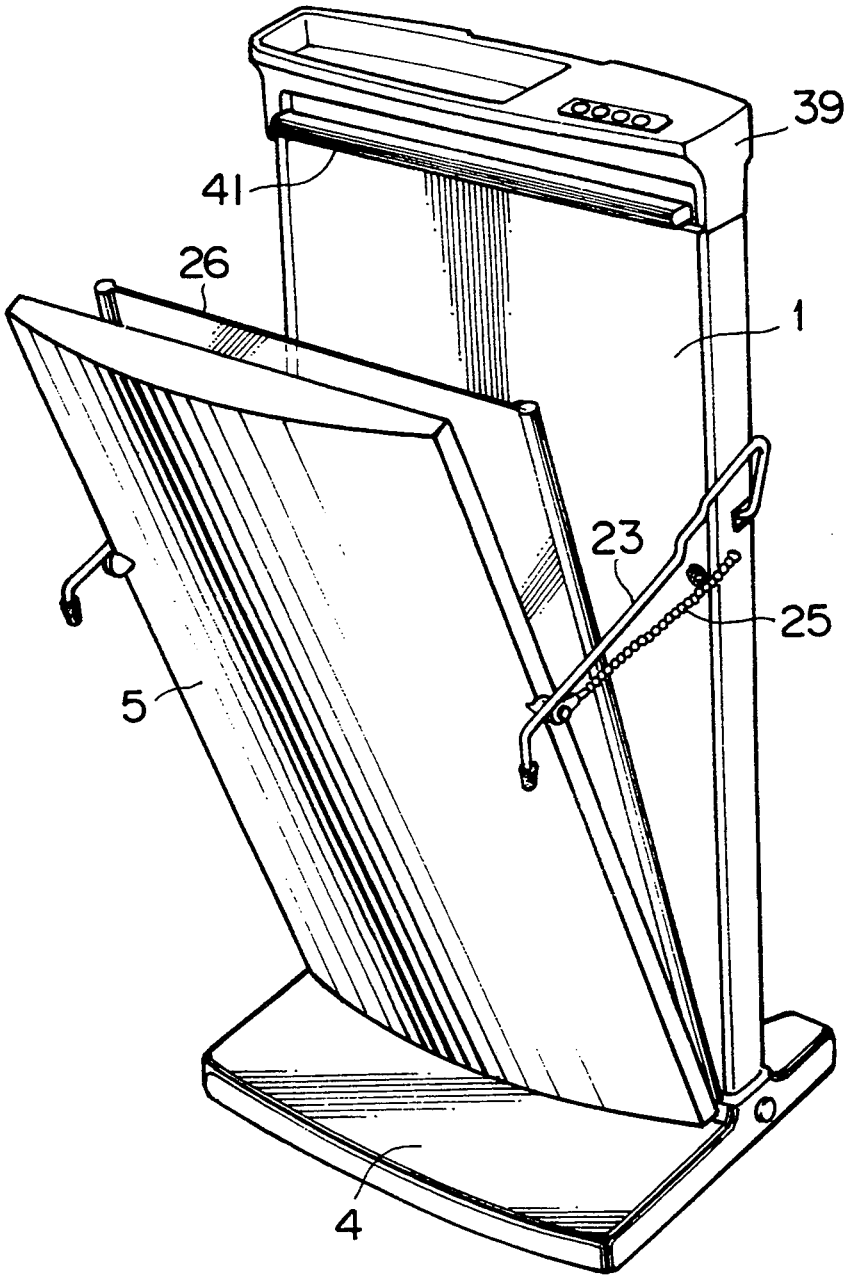
FIG. 1 is a perspective view illustrating one embodiment of a vertical-type clothes press according to the present invention.
Figure 2:
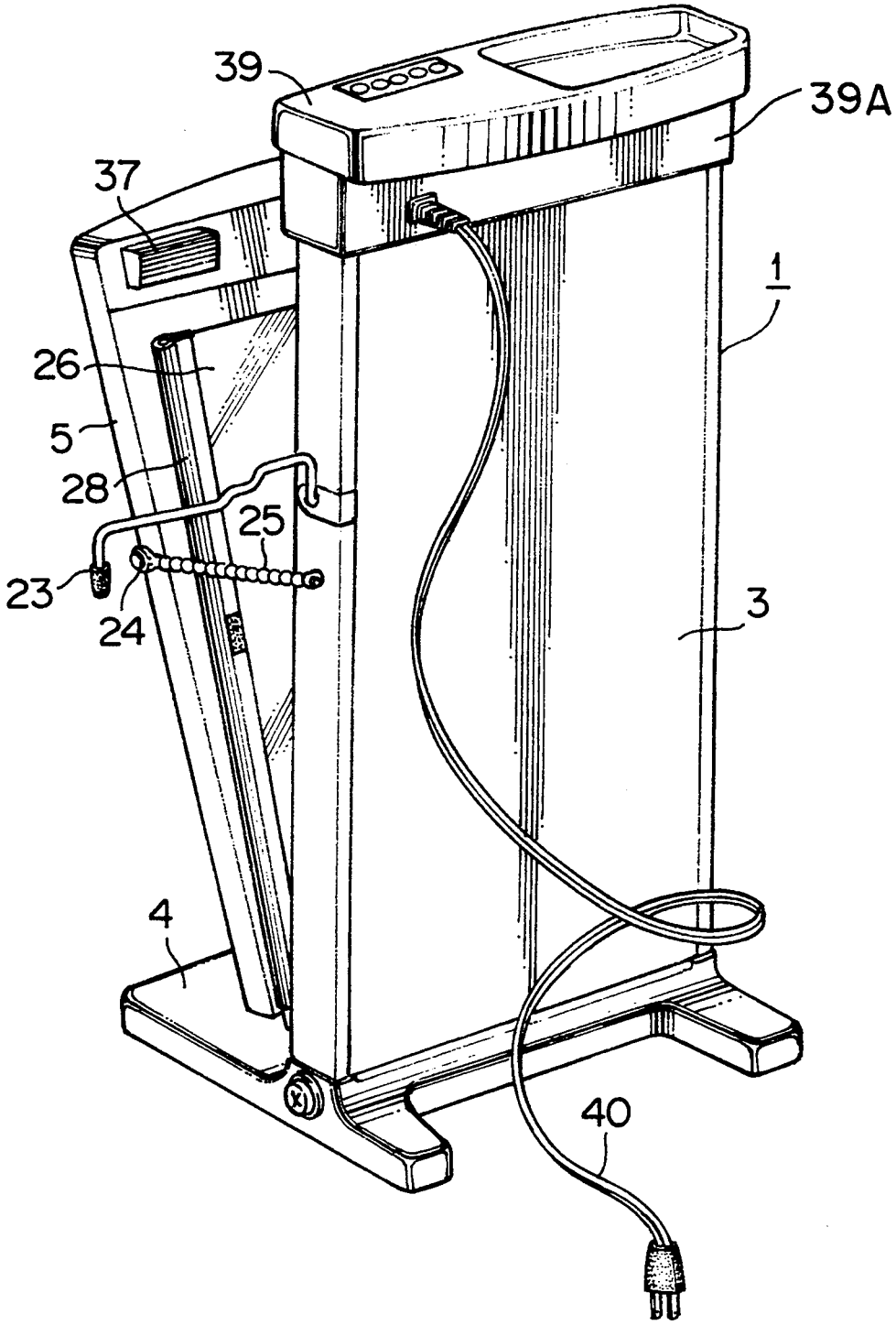
FIG. 2 is a perspective rear view illustrating the vertical-type clothes press shown in FIG. 1.
Figure 15:
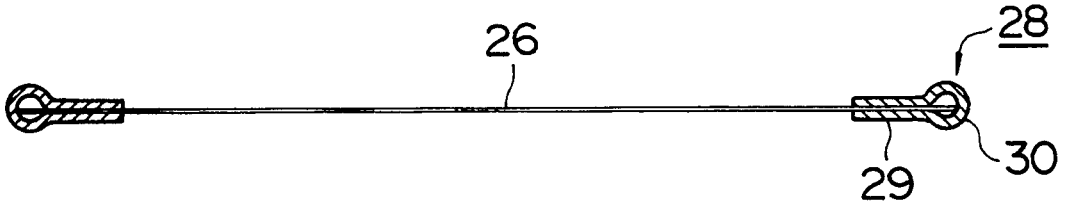
FIG. 15 is a sectional view illustrating a press sheet of the vertical-type clothes press shown in FIG. 1.

As shown in FIG. 2, the reference numeral 28 designates reinforcements provided vertically along the side ends of said press sheet 26. The reinforcements 28 have adhesive portions 29 adhesively fixed to the opposite surfaces of said press sheet (refer to FIG. 15), and a cylindrical portion 30, and are provided along the both side ends perpendicular to the axis of said shaft 27, such that said press sheet 26 can be rotatably moved between said fixed board 1 and said movable board 5 while keeping its straight state without bending even in the inclined or vertical positions.

As shown in FIG. 3 and 4, the reference numeral 31 designates a holder for holding said press sheet 26 rotatably on the inner side of the fixed board 1. Magnetic members or members having magnetization are provided on the both said press sheet 26 and fixed board 1 opposite to each other to provide the holder. More specifically, a magnetic member 32 is provided on the side of the press sheet 26, and a magnetic member having a pole opposite to that of said magnetic member 32 or a member 33 having magnetization is provided on the side of the fixed board 1. This holder 31 can hold said press sheet 26 on the side of the fixed board 1 within the range of the magnetic force irrespective of the opening state of the movable board 5.

Figure 16:
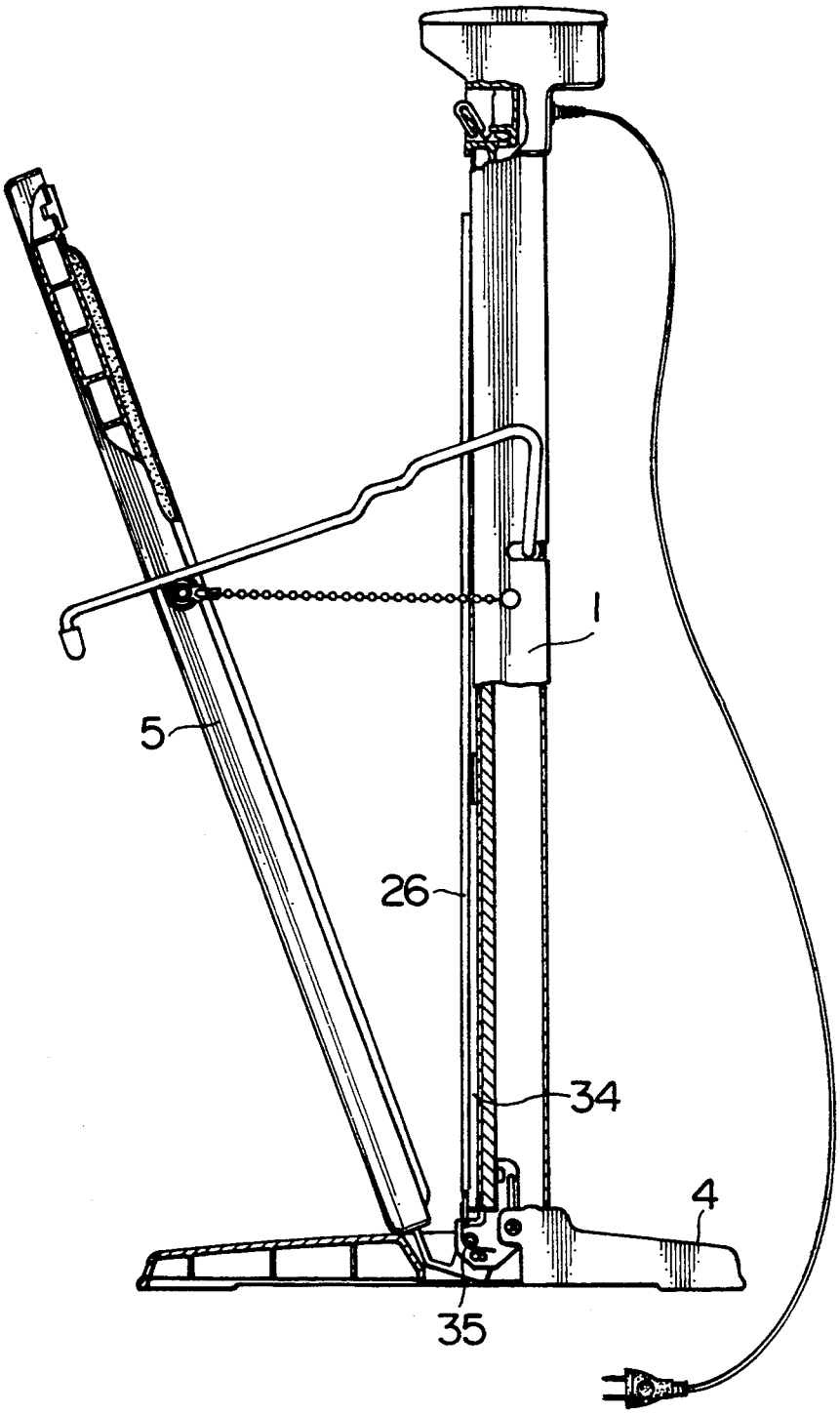
FIG. 16 is a partly sectional view illustrating another embodiment of a holder of the vertical-type clothes press machine shown in FIG. 1.

FIG. 16 illustrates another embodiment of said holder 31. A gap 34 is provided between the lower ends of the press sheet 26 and fixed board 1, and a pivot shaft 35 is provided at the lower end of the same press sheet 26 slightly closer to the side of the movable board 5 than the upper end of the same press sheet 26. Therefore, the press sheet 26 can lean against the fixed board 1 when the movable board is open, so as to facilitate setting clothes 7.

Figure 17:
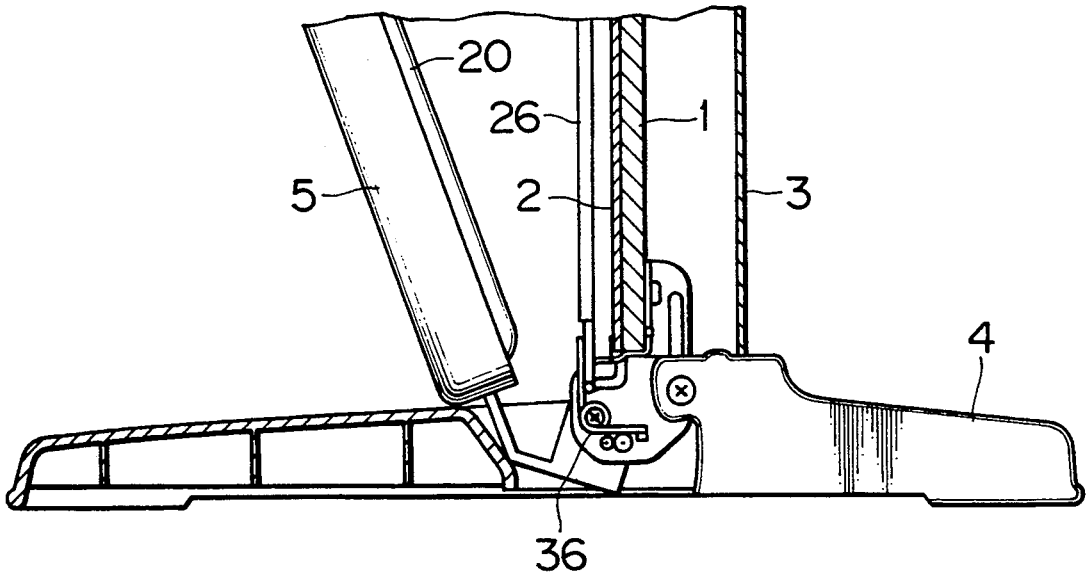
FIG. 17 is a partly sectional view illustrating another embodiment of the holder of the vertical-type clothes press shown in FIG. 1.

Further, FIG. 17 illustrates another embodiment of said holder 31. A spring member 36 is provided at the lower end of the press sheet 26 to urge the press sheet 26 toward the side of the fixed board 1, such that the similar effect described above is obtained.

Figure 18:
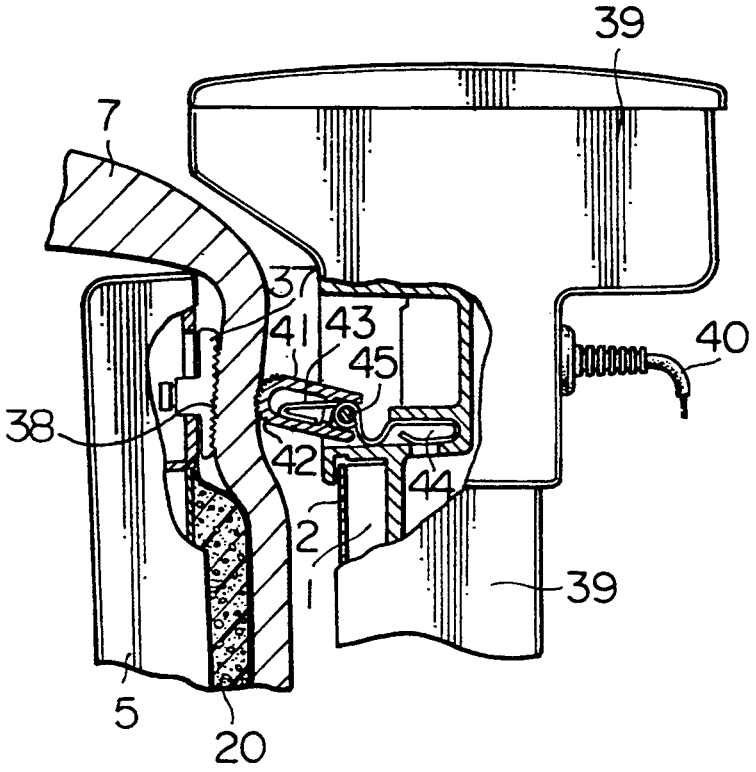
FIG. 18 is a partly sectional view illustrating the vertical-type clothes press shown in FIG. 1.
Figure 19:
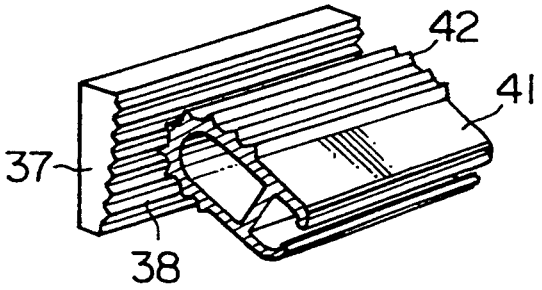
FIG. 19 is a partly perspective view illustrating the vertical-type clothes press shown in FIG. 1.

As shown in FIG. 18, the reference numeral 37 designates a slide plate slidable in a vertical direction provided above the press member 20 on the inner side of said movable board 5. The slide plates 37 are provided adjacent to the both ends of the movable board 5, and a plurality of projections 38 are formed such that the inner faces, that is, the biasing sides of the slide plates are inclined in the slidable direction so as to increase the thickness of the slide plates.

The reference numeral 39 is designates a top cover provided at the top surface of said fixed board 1 and having a controller (not shown) therein for controlling the power supply to a heater 39A, and a power cable 40 is connected to a heater circuit through said controller.

The reference numeral 41 designates a press device having a plurality of projections 42 and provided on the upper part of the fixed board 1 to be opposited to said slide plates 37. The press device 41 is mounted to a fixed hole 44 provided in said top cover 39 through a spring 43, and is pivotable on the fulcrum 45 of the spring 43 to be constantly urged toward said slide plates 37 by means of said spring 43.

Operations with respect to the above embodiment will be hereinunder described. When clothe 7 are to be pressed, the lock mechanism 23 is turned upward to release the pressing state of the movable board 5 whereby the movable board 5 is rotatably opened around the center of the hinge mechanism 6 to be away from the fixed board 1, and the movable board 5 is held by a stopper 25 to be at the predetermined position in the inclined state.

Then, the movable board 5 in the form of hollow structure has a substantial strength without distortion or twist being caused by pressing pressure, and the shift of centroid is quite small even when the movable board 5 is opened up to the position determined by the stopper 25 because the movable board 5 has a substantially reduced mass, so that the fixed board 1 can be vertically and steadily mounted on the small mount base 4.

Then, the press sheet 26 has been held on the inner side of the fixed board 1 by the holder 31, and will not lean over the side of the movable board 5 during the operation of shaping clothes 7 on the side of the movable board.

The press sheet 26 is rotated toward the side of the movable board 5 from the side of the fixed board 1 to hold the clothes in the shaped state, after the clothes 7 to be pressed are shaped in order on the upper face of a press member 20 or the inner surface of the movable board 5.

The press sheet 26 is provided along the side ends thereof with the reinforcements 28 extending vertically, so that said press sheet 26 can be rotated in its straight state without bending to thereby firmly hold the clothes 7 positioned on the side of the inclined movable board 5 in the shaped state and prevent the clothes from being shifted in position.

Said holder 31 may be composed of a holding tape, a hook or the like, a magnetic member or a magnetizing member, and thus it can be anything which can hold the rotatable press sheet 36 on the side of the fixed board 1 to prevent the press sheet 26 from leaning over the side of the movable board 5.

As the clothes 7 held on the side of the movable board 5 by the press sheet 26 are moved together with the movable board 5 toward the side of the fixed board 1, the clothes 7 are held between the press member 20 and the fixed board 1 successively from the cuffs to the upper part.

In a process for holding the clothes 7, the press device 41 and the slide plates 37 are contacted with each other so as to hold the clothes 7 therebetween. Further, as the movable board 5 is moved close to the side of the fixed board 1, the press device 41 is turned in the upward direction against the force of the spring 43, and the slide plates 37 also slide upward with the clothes 7 in response to the rotational movement of the press device 41.

Therefore, the clothes 7 can be pressed between the fixed board 1 and the movable board 5 in the state that the upper part of the clothes 7 has been upwardly stretched out, and the movable board 5 can be pressed onto the fixed board 1 by rotating the lock mechanism 23 downward.

Then an electric power is supplied to the heater circuit to heat the clothes 7 at a predetermined temperature in the pressed state whereby the clothes 7 can be pressed to smooth out wrinkles around creases, thus enabling finishing them beautifully.

Figure 20:
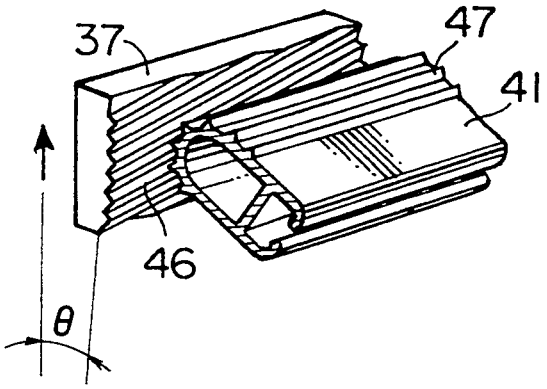
FIG. 20 is a partly perspective view illustrating another embodiment of a slide plate of the vertical-type clothes press shown in FIG. 1.
Figure 21:
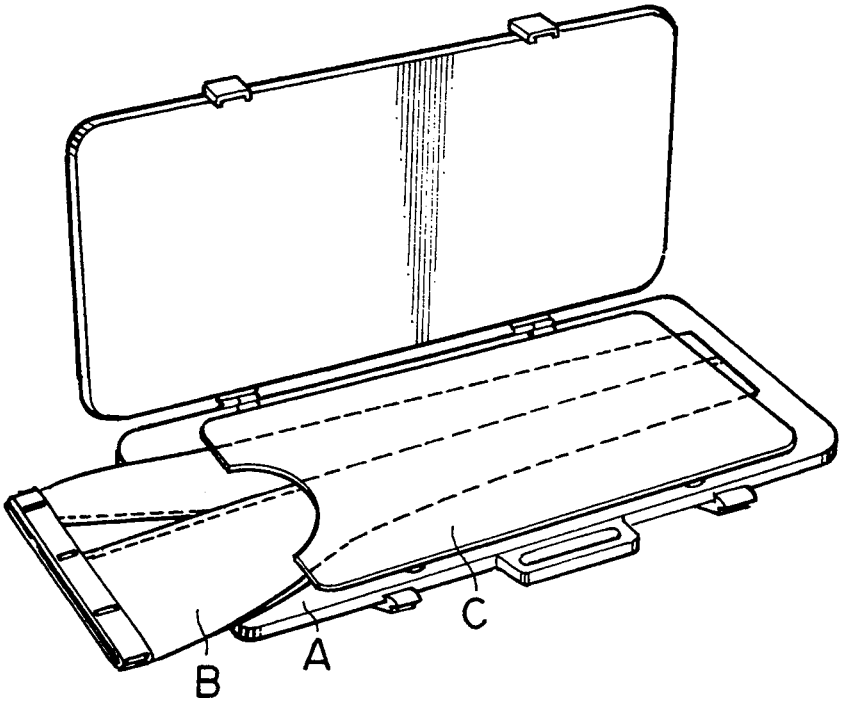
FIG. 21 PRIOR ART
FIG. 21 is a perspective view illustrating a conventional horizontal-type clothes press.
Figure 22:
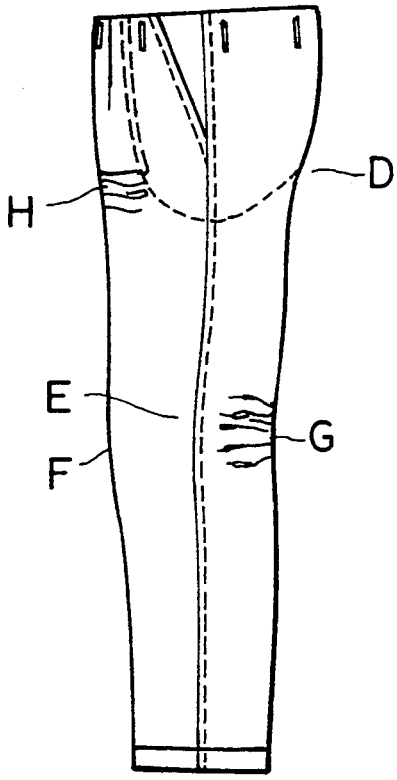
FIG. 22 is an illustration of the shape of a pair of pants.

As shown in FIG. 20, the inner face, that is, the press face of said slide plate 37 is inclined in the slidable direction in a manner to increase the thickness of the slide plate, thereby stopping a slip that would occur between the slide plates 37 and the press device 41 when the movable board 5 is moved close to the side of the fixed board 1 from the state in which the clothes 7 are held between the slide plates 37 and the press device 41.

Namely, even when only the press device 41 turns and the slide plates 37 do not slide, a gap between the slide plates 37 and the press device 41 decreases in a direction, in which a contact resistance increases, due to an angle of inclination $\theta$ of the press working surfaces of the slide plates 37 with respect to the slide direction, so that the slide plates 37 can be positively slidden upward to give a suitable tension force to the clothes 7.

The projections 46 provided on the press faces of said slide plates 37 for increasing a friction resistance with respect to the clothes 7 are oriented at a predetermined angle relative to the direction of projections 47 provided on the press device 41 to cross the projections 47, so that an engagement between the respective projections 46 and 47 is prevented even when the movable board 5 is closed without any clothes therebetween.

Therefore, the occurrence of noises caused by the engagement between the projections 46 and 47 can be prevented, and a friction resistance with respect to clothes 7 can be also maintained at high level, and further, the wear of the projections 46 and 47 can be also prevented.

Further, the slide plates 37 are provided at the upper both ends on the inner face of the movable board 5, so that the thicker portions of clothes 7 such as stitches and a zipper than creases get free of pressing. Therefore, a tension force can be applied to only the both ends of clothes so as to press the clothes in the state that wrinkles around creases have been smoothed, irrespective of the thickness and shape of clothes 7.

As described above, a vertical-type clothes press according to the present invention comprises a fixed board and a movable board, at least one of which has a heater, and for hot-pressing clothes or the like, a mount base which fixes the lower end of said fixed board to make the board stand vertically, a hinge mechanism which rotatably connects the lower ends of said fixed board and movable board to each other, and supports said movable board in opposed relationship to said fixed board so as to freely open, a lock mechanism for holding said movable board to bias the same against said fixed board, said movable board being of a hollow structure, so that the mass of the movable board is reduced and the shift of centroid is also kept small when the movable board is open.

Therefore, a mount base for vertical installation can be reduced in size, and be stably maintained without fluctuation while clothes are shaped in order.

The small-sizing of the mount base eliminates any unduly large extention of the base on this side which would make an obstacle in use and over which a person would stumble, so that a compact and handy, vertical-type clothes press adapted for safe installation in a small space can be realized.

Further, the small mass of the movable board will lead to reduction in the magnitude of impacts caused by opening/closing action. Therefore, the force on hinges and stoppers also becomes relatively small even when the movable board is suddenly opened, and the strengths for couplings and stoppers can be set to low level, and these parts can be manufactured effectively at low cost.

In a vertical-type clothes press according to the present invention, the press sheet has one end connected at the side of the convection between a fixed board and a movable board and is rotatably arranged between said fixed board and said movable board, and reinforcements are provided vertically along the side ends of the press sheet, so that the press sheet can stand alone without bending even in the inclined and vertical state.

Consequently, clothes held in order can be firmly fixed on the inclined movable board, and the downward shift of clothes caused by the rotatable movement of the movable board can be also prevented, so that wrinkles or double lines on the clothes after the clothes having been held in order can be also eliminated to provide a preferred pressing.

Further, the holder for holding the press sheet on the side of the fixed board is provided, so that the press sheet can be held on the side of the fixed board while clothes are being held in order on the movable board. Consequently, the procedures in setting clothes can be easily performed and a vertical-type clothes press improved in finishing quality and convenience can be realized since the press sheet does not fall down to the side of the fixed board while clothes are held in order.

Further, in a vertical-type clothes press according to the present invention, clothes placed between a fixed board and a movable board can be stably lifted up by a rotatable press device and slide plates. Accordingly, even clothes such as a pair of pants, of which clothes overlap each other, can be steadily lifted up. Consequently, hot-pressing can be performed after wrinkles and bags on clothes are substantially smoothed to provide a preferred finishing effect.

Slide plates become gradually thicker in the slidable direction to make the press faces thereof inclined, so that slip caused by the decrease in friction resistance between the slide plates and the press device when thick clothes such as a pair of pants are inserted, can be prevented.

Projections are provided onto the respective press faces of slide plates and a press device, and the both projections are formed at a predetermined angle crossing each other, whereby noises caused by a slip occurred when the slide plates and press device are operated without clothes, are lowered without the decrease in a friction resistance between each contact face of the slide plates and press device, and clothes.

Either one of slide plates or a press device is provided at the both ends of clothes or the like held between the slide plates and press device opposite to each other, thereby only a part in vicinity of the creases at the front and rear parts of a pair of pants other than the stitch parts, can be pulled up, so as to operate it without regard to the thickness of clothes.

What is claimed is:

1. A clothes press for hot-pressing clothes, comprising:

a mount base adapted to be positioned in a horizontal plane;

a fixed board which has a lower end fixed to said mount base and which extends in a vertical direction relative to said mount base;

a movable board which has a lower end pivotally attached to a portion of said fixed board adjacent to said lower end of said fixed board and which is movable toward and away from said fixed board, a major portion of said movable board comprising a hollow structure which comprises a panel for pressing clothes between said movable board and said fixed board, center cores for supporting said panel, and an outer wall provided at a side of said center cores opposite said panel; and a lock mechanism mounted on said movable board and said fixed board for holding said movable board in a state in which said movable board is pressed against said fixed board.

2. A clothes press according to claim 1, wherein the panel or outer wall of said movable board is formed integrally with said center cores.

3. A clothes press according to claim 2, wherein said center cores being smaller in a lower part of said movable board than in an upper part of said movable board.

4. A clothes press according to claim 2, wherein said center cores being smaller in a central part of said movable board than in side parts of said movable board.

5. A clothes press according to claim 2, wherein said panel, center cores and outer wall being formed of a material selected from among light metal, plastic, paper, and a combination of these materials.

6. A clothes press according to claim 1, wherein said center cores being smaller in a lower part of said movable board than in an upper part of said movable board.

7. A clothes press according to claim 1, wherein said center cores being smaller in a central part of said movable board than in side parts of said movable board.

8. A clothes press according to claim 1, wherein said panel, center cores and outer wall being formed of a material selected from among light metal, plastic, paper, and a combination of these materials.

9. A clothes press according to claim 1, wherein said movable board comprises a frame member in which a hollow panel having center cores is positioned.

10. A clothes press according to claim 9, wherein said center cores being smaller in a lower part of said movable board than in an upper part of said movable board.

11. A clothes press according to claim 9, wherein said center cores being smaller in a central part of said movable board than in side parts of said movable board.

12. A clothes press according to claim 9, wherein said panel, center cores and outer wall being formed of a material selected from among light metal, plastic, paper, and a combination of these materials.

13. A clothes press according to claim 1, wherein said center cores being smaller in a lower part of said movable board than in an upper part of said movable board.

14. A clothes press according to claim 13, wherein said panel, center cores and outer wall being formed of a material selected from among light metal, plastic, paper, and a combination of these materials.

15. A clothes press according to claim 1, wherein said center cores being smaller in a central part of said movable board than in side parts of said movable board.

16. A clothes press according to claim 15, wherein said panel, center cores and outer wall being formed of a material selected from among light metal, plastic, paper, and a combination of these materials.

17. A clothes press according to claim 1, wherein said panel, center cores and outer wall being formed of a material selected from among light metal, plastic, paper, and a combination of these materials.

18. A clothes press for hot-pressing clothes, comprising:

a mount base adapted to be positioned in a horizontal plane;

a fixed board which has a lower end fixed to said mount base and which extends in a vertical direction relative to said mount base.

a movable board pivotally attached at a lower end of said movable board to a portion of said fixed board adjacent to said lower end of said fixed board and movable toward and away from said fixed board, said movable board having a hollow structure and serving to press clothes between said movable board and said fixed board;

a hinge mechanism which rotatably connects said lower ends of said fixed board and movable board to each other, and supports said movable board in opposed relationship to said fixed board;

a lock mechanism mounted on said movable board and said fixed board for holding said movable board in a state in which said movable board is pressed against said fixed board;

a press sheet having one end attached to said hinge mechanism and rotatably provided between said movable board and said fixed board; and reinforcements provided along side end faces of said press sheet in a vertical direction.

19. A clothes press according to claim 18 further comprising a holder for holding said press sheet on the fixed board.

20. A clothes press according to claim 19, wherein said holder comprises a spring for urging said press sheet toward the fixed board.

21. A clothes press according to claim 19, wherein said holder comprises a gap provided between a lower end of said press sheet and the fixed board, and said press sheet comprises a rotatable shaft provided slightly closer to the movable board than an upper end of the said press sheet.

22. A clothes press comprising:

a fixed board and a movable board, at least one of which has a heater for hot-pressing clothes between said fixed board and said movable board;

a hinge means for rotatably coupling one end of said fixed board to one end of said movable board to make said movable board openable and closable with respect to said fixed board; and biasing means provided on said hinge mechanism for pulling clothes held between said fixed board and said movable board toward an end of said clothes press opposite said hinge mechanism, said biasing means comprising a press device provided at either said fixed board or said movable board and rotatably held and urged onto an inner side of said clothes press by means of a spring, and further comprising slide plates provided opposite to said press device for holding clothes between said slide plates and said press device, and said slide plates being capable of sliding in a direction of pulling clothes in cooperation with the rotatable movement of said press device.

23. A clothes press according to claim 22, wherein said slide plates are of non-uniform thickness to make press faces of said slide plates inclined in the slidable direction.

24. A clothes press according to claim 23, wherein projections are provided on confronting press faces of said slide plates and said press device, and said both projections are formed to cross each other at a predetermined angle.

25. A clothes press according to claim 23, wherein at least either one of said slide plates or said press device is provided in opposition to opposite ends of clothes held between said slide plates and said press device.

26. A clothes press according to claim 22, wherein projections are provided on confronting press faces of said slide plates and said press device, and said both projections are formed to cross each other at a predetermined angle.

27. A clothes press according to claim 26, wherein at least either one of said slide plates or said press device is provided in opposition to opposite ends of clothes held between said slide plates and said press device.

28. A clothes press according to claim 22, wherein at least either one of said slide plates or said press device is provided in opposition to opposite ends of clothes held between said slide plates and said press device.

29. A clothes press comprising:

a mount base;

a fixed board vertically mounted on said base and having heater on one side of said fixed board;

a movable board provided in opposition to said fixed board and comprising a hollow structure for hot-pressing clothes held between said movable board and said fixed board;

a hinge means for rotatably connecting a lower end of said fixed board a a lower end of said movable board to each other, and for mounting said movable board openably and closably on said fixed board;

a lock mechanism attached to said fixed board and said movable board for holding said movable board in a state in which said movable board is pressed against said fixed board;

a press sheet having one end attached to said hinge means so as to pivot between said movable board and said fixed board; and reinforcements provided along side end faces of said press sheet in a vertical direction.

30. A clothes press comprising:

a mount base;

a fixed board vertically mounted on said base and having. heater on one side of said fixed board, a movable board provided in opposition to said fixed board, and comprising a hollow structure for hot-pressing clothes held between itself and said fixed board;

a hinge means for rotatably connecting a lower end of said fixed board and a lower end of said movable board to each other, and for mounting said movable board openably and closably on said fixed board;

a lock mechanism mounted on said movable board and said fixed board for holding said movable board in a state in which said movable board is held against said fixed board;

a press sheet having one end attached to said hinge means so as to pivot between said movable board and said fixed board;

reinforcements provided along side end faces of said press sheet in a vertical direction; and bias means provided on said hinge mechanism for pulling clothes held between said fixed board and said movable board in toward an end of said clothes press opposite said hinge mechanism.

* * * * *